US009444166B2

(12) United States Patent
Ohyama et al.

(10) Patent No.: US 9,444,166 B2
(45) Date of Patent: Sep. 13, 2016

(54) CONNECTOR FOR FLAT CABLE

(71) Applicant: YAZAKI CORPORATION, Tokyo (JP)

(72) Inventors: Kouichi Ohyama, Shizuoka (JP); Kazunori Miura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/527,084

(22) Filed: Oct. 29, 2014

(65) Prior Publication Data

US 2015/0056840 A1 Feb. 26, 2015

Related U.S. Application Data

(63) Continuation of application No. PCT/JP2013/065762, filed on May 31, 2015.

(30) Foreign Application Priority Data

Jun. 4, 2012 (JP) ..... 2012-126667

(51) Int. Cl.
*H01R 12/77* (2011.01)
*H01R 13/639* (2006.01)
(Continued)

(52) U.S. Cl.
CPC ..... *H01R 12/774* (2013.01); *H01R 13/639* (2013.01); *H01R 12/59* (2013.01);
(Continued)

(58) Field of Classification Search
CPC .... H01R 12/721; H01R 12/78; H01R 12/79; H01R 12/59; H01R 12/77; H01R 23/66; H01R 12/61
USPC ..... 439/329, 492, 495, 260
See application file for complete search history.

(56) References Cited

U.S. PATENT DOCUMENTS

2006/0292911 A1* 12/2006 Ning ..... H01R 12/79 439/260
2008/0214044 A1 9/2008 Ko et al.
(Continued)

FOREIGN PATENT DOCUMENTS

CN 1538569 A 10/2004
GB 2 337 164 A 11/1999
(Continued)

OTHER PUBLICATIONS

International Search Report and Written Opinion of the International Search Report for PCT/JP2013/065762 dated Aug. 20, 2013.
(Continued)

*Primary Examiner* — Abdullah Riyami
*Assistant Examiner* — Justin Kratt
(74) *Attorney, Agent, or Firm* — Kenealy VaidyaLLP

(57) ABSTRACT

A connector for a flat cable connecting a connection terminal part of a flat cable to an electronic device includes a housing, a terminal, and a lock member. The housing is fixed to the electronic device and is formed with an insertion part into which a flat cable is inserted and a flat cable accommodation space that continues from the insertion part to an inside of the housing. The terminal is aligned and disposed in the housing, is connected to a wiring terminal provided to the electronic device and is contact-connected to the connection terminal part of the flat cable when the flat cable is inserted into the flat cable accommodation space. The lock member is put on a backside of a surface of the housing facing the electronic device and is formed with a pair of flat cable holding parts engageable with locking holes.

1 Claim, 8 Drawing Sheets

(51) Int. Cl.

| | |
|---|---|
| *H01R 12/79* | (2011.01) |
| *H01R 12/72* | (2011.01) |
| *H01R 12/78* | (2011.01) |
| *H01R 12/61* | (2011.01) |
| *H01R 12/70* | (2011.01) |
| *H01R 12/59* | (2011.01) |

(52) U.S. Cl.
CPC ..... *H01R 12/61* (2013.01); *H01R 12/721* (2013.01); *H01R 12/78* (2013.01); *H01R 12/79* (2013.01); *H01R 23/66* (2013.01)

(56) References Cited

U.S. PATENT DOCUMENTS

| | | | | |
|---|---|---|---|---|
| 2011/0136365 | A1* | 6/2011 | Hara ..... | H01R 12/79 439/329 |
| 2012/0129400 | A1 | 5/2012 | Ohyama | |

FOREIGN PATENT DOCUMENTS

| | | | | |
|---|---|---|---|---|
| JP | 3118913 | U | | 2/2006 |
| JP | 2008-192574 | A | | 8/2008 |
| JP | 2008192574 | A | * | 8/2008 |
| JP | 2011-119162 | A | | 6/2011 |
| JP | 2012-22848 | A | | 2/2012 |
| WO | 2012/008353 | A1 | | 1/2012 |

OTHER PUBLICATIONS

Japanese Office Action for the related Japanese Patent Application No. 2012-126667 dated Nov. 17, 2015.

Chinese Office Action for the related Chinese Patent Application No. 201380029658.9 dated Jan. 4, 2016.

Chinese Office Action for the related Chinese Patent Application No. 201380029658.9 dated Jul. 4, 2016.

* cited by examiner

CONNECTOR FOR FLAT CABLE

CROSS REFERENCE TO RELATED APPLICATIONS

This application is a continuation of PCT application No. PCT/JP20131065762, which was filed on May 31, 2013 based on Japanese Patent Application No. 2012-126667 filed on Jun. 4, 2012, the contents of which are incorporated herein by reference.

TECHNICAL FIELD

The invention relates to a connector for a flat cable that connects a flat cable and an electronic device with each other.

BACKGROUND ART

For interconnection of various electronic devices, a flat cable and the like is used so as to reduce a wiring space and to improve the degree of freedom of a wiring path. The flat cable and the various electronic devices are usually connected via a detachable connector for a flat cable.

PTL 1 and PTL 2 disclose the connector for a flat cable. In PTL 1, a lock part is engaged to a flat cable that is inserted to a housing through an insertion part. Thereby, the flat cable is prevented from being unintentionally separated from the connector.

The connector for a flat cable disclosed in PTL 1 is described with reference to FIGS. 8 to 11. As shown in FIG. 8, the connector for a flat cable disclosed in PTL 1 has a configuration where a plurality of contacts is aligned and disposed to a housing B in a longitudinal direction of the housing B, and is fixed to a main wiring substrate (not shown) via a mounting reinforcement fitting C. The housing B is formed with an insertion part A. As shown in FIG. 9, a flat cable E is inserted into the housing B through the insertion part A.

As shown in FIG. 10, the mounting reinforcement fitting C is integrally formed with a lock part D. The flat cable E inserted into the housing B is locked by the lock part D, so that the flat cable E is prevented from being unintentionally separated. Also, as shown in FIG. 11, a pressing force directed towards an inside of the housing B is applied to one end portion G of a lock release part F that is integrally provided to the housing B. Thereby, the other end portion (not shown) of the lock release part F is pressed to move the lock part D, so that the locked state of the flat cable B is released.

CITATION LIST

Patent Literature

PTL 1 JP-A-2011-119162
PTL 2 JP-A-2012-22848

SUMMARY OF INVENTION

Technical Problem

Since the connector for a flat cable disclosed in PTL 1 has many components for locking the flat cable E, such as the 'lock release part F', the 'lock part D', the 'mounting reinforcement fitting C' and the like, there are many demerits as regards the mounting ability and cost.

Also, since the lock release parts F are independently provided at left and right sides, it is not possible to release the locked state of the flat cable B unless the lock release parts F of the left and right sides are pressed at the same time. Therefore, it is troublesome to separate the flat cable E from the housing B.

Furthermore, since the lock release part F is small, if the flat cable E is semi-inserted, it is difficult to detect the semi-inserted state, so that the semi-inserted state of the flat cable E may be overlooked. As a result, a connection job may be completed at a state where an electrical connection state between a connection terminal part of the flat cable E and the contacts is imperfect, which causes a connection defect.

Regarding the above problems, an object of the invention is to provide a connector for a flat cable capable of reducing the number of components for locking a flat cable and simplifying jobs of connecting and separating the flat cable and the connector.

Solution to Problem (1) According to an aspect of the invention, a connector for a flat cable connecting a connection terminal part of a flat cable to an electronic device includes a housing, a terminal, and a lock member. The housing is fixed to the electronic device and is formed with an insertion part into which a flat cable is inserted and a flat cable accommodation space that continues from the insertion part to an inside of the housing. The terminal is aligned and disposed in the housing, is connected to a wiring terminal provided to the electronic device and is contact-connected to the connection terminal part of the flat cable when the flat cable is inserted into the flat cable accommodation space through the insertion part. The lock member is put on a backside of a surface of the housing facing the electronic device and is formed with a pair of flat cable holding parts, which is engageable with locking holes formed at both side edge area at a leading end-side of the flat cable when the connection terminal part of the flat cable is contact-connected to the terminal and an extension part that extends over the pair of flat cable holding parts.

(2) In the connector for a flat cable of (1), the backside of the surface of the housing facing the electronic device is formed into a step shape including a lower step surface having a notch in which the lock member is accommodated and an upper step surface having no notch. In addition, the lock member is configured so that when the flat cable is inserted into the insertion part of the housing, the flat cable holding parts are contacted to the leading end-side of the flat cable and are separated from the housing and a backside of a surface of the extension part on which the flat cable holding parts are formed protrudes from the upper step surface of the housing and so that when the flat cable reaches a holding position of the flat cable accommodation space and the connection terminal part of the flat cable are contact-connected to the terminal, the flat cable holding parts are engaged with the locking holes of the flat cable and come close to the housing and the backside of the surface of the extension part on which the flat cable holding parts are formed becomes flush with the upper step surface of the housing.

(3) The connector for a flat cable of (1) or (2) further includes a pressing member that is formed with: a press-fitting part that is press-fitted into a recess formed at the housing; an arm part that is engaged with an engaging recess formed at the lock member and presses the lock member towards the housing; and a fixing part that is fixed to the electronic device.

Advantageous Effects of Invention

According to the configurations of (1) to (3), it is possible to reduce the number of components for locking the flat cable and simplifying the jobs of connecting and separating the flat cable and the connector.

DESCRIPTION OF EMBODIMENTS

Hereinafter, a connector for a flat cable according to first and second illustrative embodiments will be specifically described with reference to FIGS. 1 to 7.

First Illustrative Embodiment

Figure 1:
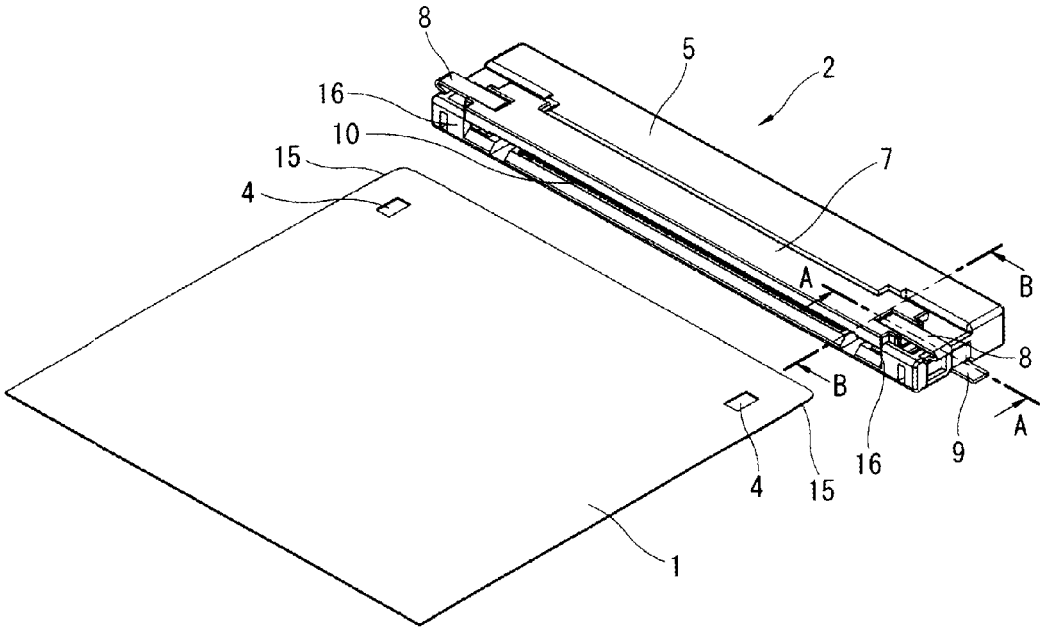
FIG. 1 is a perspective view showing a connector for a flat cable according to a first illustrative embodiment and a flat cable.

FIG. 1 is a perspective view showing a flat cable 1 and a connector for a flat cable according to a first illustrative embodiment.

A flat cable 1 has a flat plate shape and is formed at its one end with a connection terminal part (not shown) with a connector 2 for a flat cable. Also, the flat cable 1 is formed at both edge sides of the one end with locking holes 4, 4.

Figure 2:
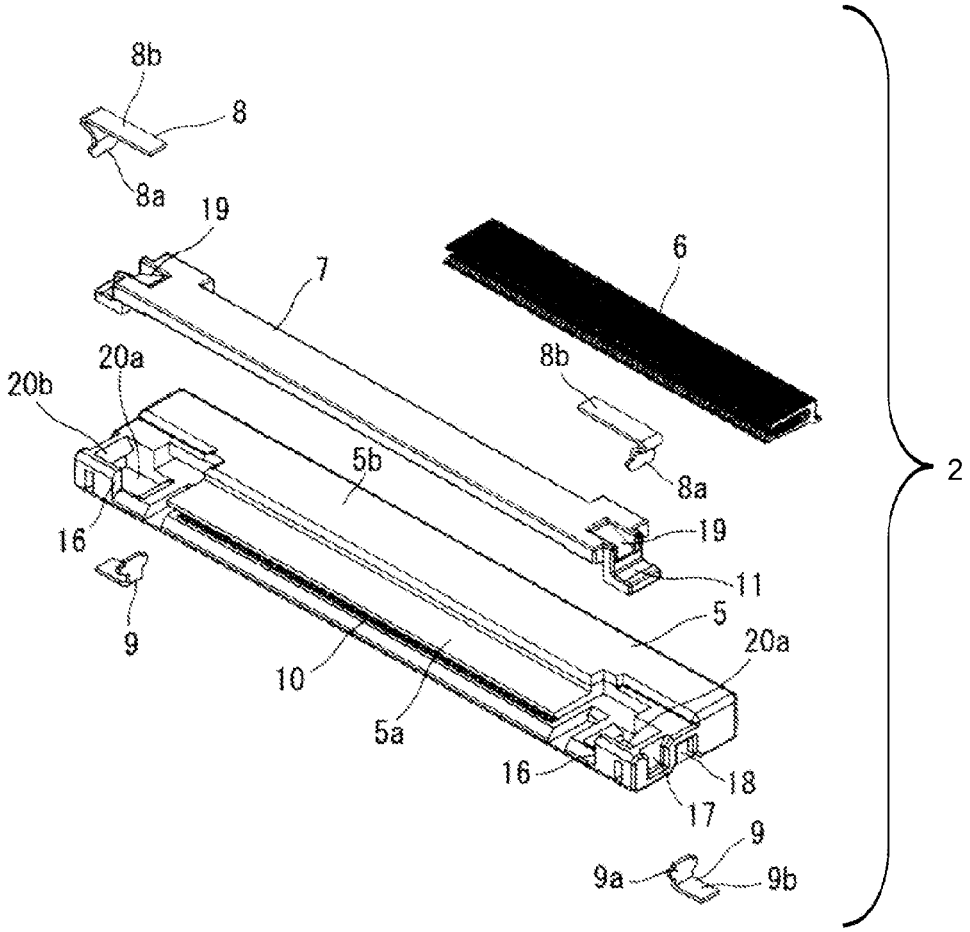
FIG. 2 is an exploded perspective view showing the connector for a flat cable according to the first illustrative embodiment.

As shown in FIGS. 1 and 2, the connector 2 for a flat cable has a terminal 6 that is connected to the connection terminal part of the flat cable 1, a housing 5 that accommodates therein the terminal 6, a lock member 7 that locks the flat cable 1 inserted into the housing 5, pressing members 8 that press the lock member 7 towards the housing 5 and fixing members 9 that fix the housing 5 to a variety of electronic devices (for example, wiring substrate).

The housing 5 has a substantial rectangular parallelepiped shape and is formed with an insertion part 10 for inserting the flat cable 1 along a longitudinal direction thereof. A flat cable accommodation space (not shown) extends from the insertion part 10 towards an inside of the housing 5. The insertion part 10 is formed at its both sides with wall-shaped parts 16, 16 for restraining a position (a longitudinal position) of the flat cable 1 in the housing 5. A size between the wall-shaped parts 16, 16 is set to be the same as or slightly larger than a width size of the flat cable 1.

Also, an upper surface (a backside of a surface facing an electronic device) of the housing 5 is formed into a step shape by a lower step surface 5*a* having a notch in which the lock member 7 is accommodated and an upper step surface 5*b* having no notch. Also, the lower step surface 5*a* of the housing 5 is formed at its both end sides with accommodation parts 20*a* that accommodate therein separation preventing locking parts 11 of the lock member 7 (which will be described later) and locking protrusions 20*b* that lock the separation preventing locking parts 11. Furthermore, both ends of the housing 5 are respectively formed with a recess 17 into which a press-fitting part 8*a* of the pressing member 8 is press-fitted and a recess 18 into which a press-fitting part 9*a* of the fixing member 9 is press-fitted.

Figure 3:
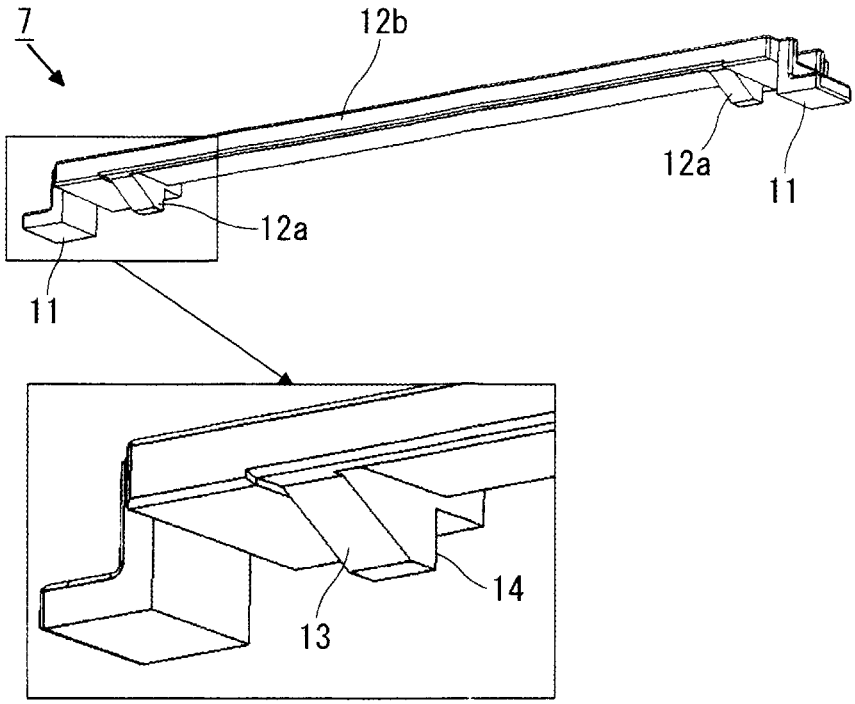
FIG. 3 is a perspective view showing a lock member in the first illustrative embodiment.

As shown in FIG. 3, the lock member 7 is provided with a pair of flat cable holding parts 12*a*, 12*a* that is engaged into the locking holes 4 of the flat cable 1, an extension part 12*b* that extends over the pair of flat cable holding parts 12*a*, 12*a* and the separation preventing locking parts 11 that extend into a substantial L shape at both ends of the extension part 12*b*. One side surface (a surface facing the insertion part 10 when mounted to the housing 5) of the flat cable holding part 12*a* is formed with a taper 13 that is upwards inclined from the insertion part 10 towards the flat cable accommodation space, and the other side surface (a surface opposite to the insertion part 10 when mounted to the housing 5) is formed with a locking surface 14 that is perpendicular to the extension part 12*b*. At a state where the lock member 7 is put on the housing 5, the upper step surface of the housing 5 is flush with an upper surface (a backside of the surface on which the flat cable holding parts 12*a*, 12*a* are formed) of the extension part 12*b*, so that the same plane is formed. Also, an upper surface (a backside of a surface facing the housing 5) of the lock member 7 is formed at its both end sides with engaging recesses 19 that are engaged with the pressing members 8.

As shown in FIG. 2, the pressing member 8 is formed by a press-fitting part 8*a* that is press-fitted into the recess 17 of the housing 5 and an arm part 8*b* that is engaged to the engaging recess 19 of the lock member 7.

The fixing member 9 is formed by a press-fitting part 9*a* that is press-fitted into the recess 18 of the housing 5 and a fixing part 9*b* that is fixed to an electronic component.

The terminal 6 is accommodated in the housing 5 and is aligned and disposed along the longitudinal direction of the housing 5. One end of the terminal 6 is connected to the connection terminal part of the flat cable 1.

With the connector 2 for a flat cable, the press-fitting parts 9*a* of the fixing members 9 are press-fitted into the recesses 18 of the housing 5 and the fixing parts 9*b* of the fixing members 9 are fixed to the electronic component, so that the housing 5 is fixed to the electronic component. The other end of the terminal 6 is electrically connected to the electronic component (not shown) by a soldering and the like. Also, the lock member 7 is put on the lower step surface 5*a* of the housing 5 and the separation preventing locking parts 11, 11 of the lock member 7 are accommodated in the accommodation parts 20*a*, 20*a* of the housing 5. Then, the arm parts 8*b* of the pressing members 8 are engaged with the engaging recesses 19 of the lock member 7 and the press-fitting parts 8*a* are press-fitted into the recesses 17. By elastic forces of the arm parts 8*b* of the pressing members 8, the lock member 7 is pressed to the housing 5. Thereby, the assembling of the connector 2 for a flat cable is completed. In the meantime, the lock member 7 can be vertically moved even at a state where the pressing members 8 are attached thereto.

Subsequently, operations of the connector 2 for a flat cable, which are made when connecting and separating the flat cable 1 to and from the connector 2 for a flat cable, are described with reference to FIGS. 4A to 4C.

(1) Upon Connection of Flat Cable

Figure 4A:
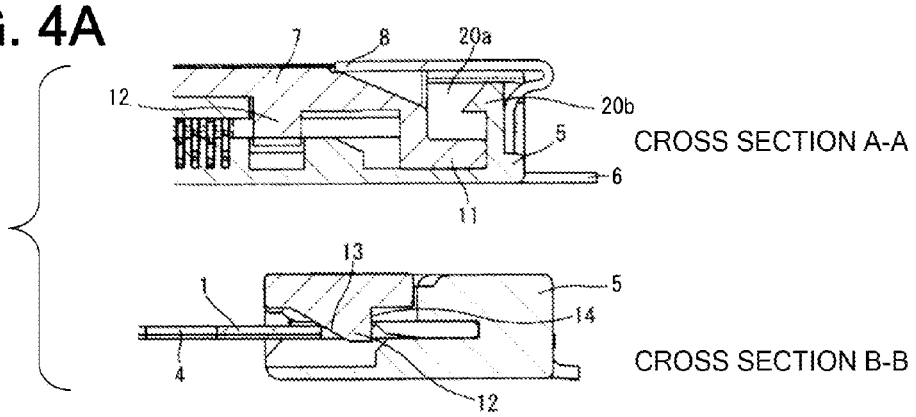
FIG. 4A is a sectional view showing the flat cable and the connector for the flat cable before insertion.

As shown in FIG. 4A, the flat cable 1 is inserted into the accommodation space in the housing 5 through the insertion part 10 of the connector 2 for a flat cable (the housing 5). At this time, a position of the flat cable 1 in the left-right direction (the alignment direction of the terminal 6) is restrained as left and right end surfaces 15 thereof abut on the wall-shaped parts 16 of the housing 5.

Figure 4B:
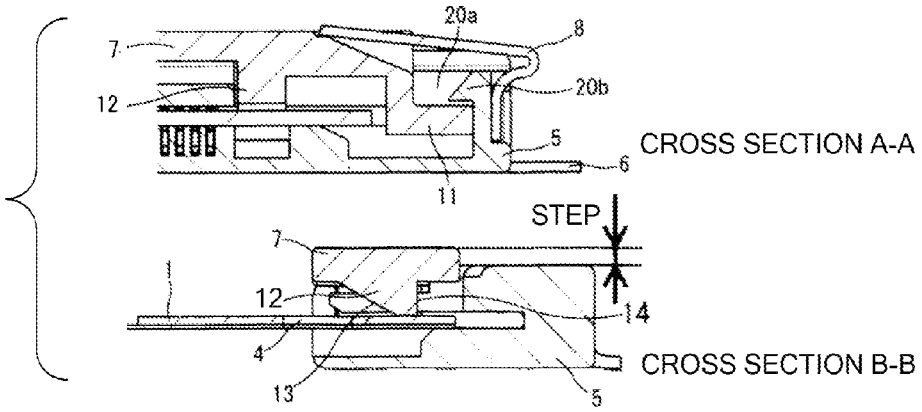
FIG. 4B is a sectional views showing the flat cable and the connector for the flat cable during the insertion.

As shown in FIG. 4B, when the flat cable 1 is inserted into the accommodation space of the housing 5, the connection terminal part of the flat cable 1 is slid along the tapers 13 of the flat cable holding parts 12*a* of the lock member 7, thereby lifting up the lock member 7 against the elastic forces of the pressing members 8. At this time, the upper surface (the backside of the surface on which the flat cable holding parts 12*a*, 12 are formed) of the extension part 12*b* becomes higher than the upper step surface 5*b* of the housing 5, so that a step is formed.

Figure 4C:
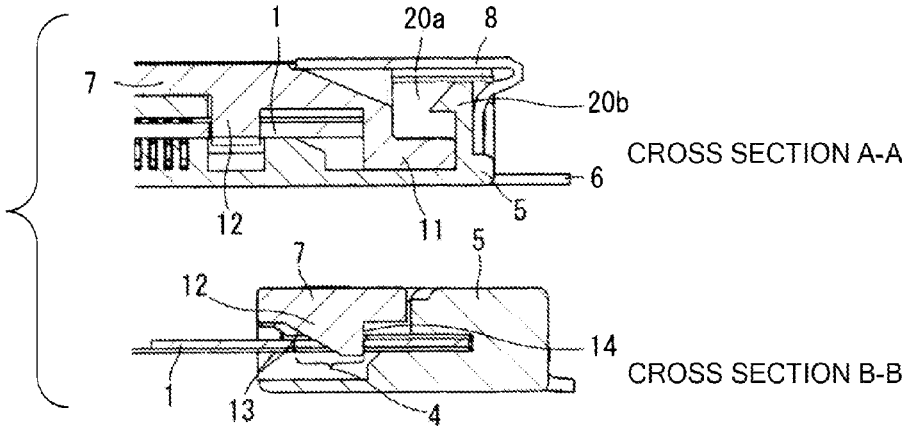
FIG. 4C is a sectional views showing the flat cable and the connector for the flat cable after the insertion.

As shown in FIG. 4C, when the flat cable 1 is inserted to a holding defined position of the accommodation space in the housing 5, the flat cable holding parts 12*a* are engaged into the locking holes 4 of the flat cable 1 and the lock member 7 is downwards moved by the elastic forces of the pressing members 8 and is returned to its original position. At this time, the upper step surface 5*b* of the housing 5 becomes flush with the upper surface (the backside of the surface on which the flat cable holding parts 12*a*, 12 are formed) of the extension part 12*b*, so that the same plane is formed.

Like this, the flat cable 1 is locked by the locking holes 4 and the locking surfaces 14 of the lock member 4, so that the flat cable 1 is prevented from being unintentionally separated from the connector 2 for a flat cable (the housing 5).

(2) Upon Separation of Flat Cable

As shown in FIG. 4B, when the lock member 7 is lifted up to move the locking surfaces 14, 14 of the flat cable holding parts 12*a*, 12*a* upwards beyond the locking holes 4, the locked state of the flat cable 1 is released. Thereby, the flat cable 1 inserted in the connector 2 for a flat cable is subject to a state where it can be separated from the connector 2 for a flat cable.

Also, when the lock member 7 is further lifted up, the separation preventing locking parts 11 of the lock member 7 are contacted to the locking protrusions 20*b* formed in the accommodation parts 20*a*. Therefore, the lock member 7 is retrained from being further moved upwards, so that the lock member 7 is suppressed from being separated from the housing 5.

As described above, according to the connector 2 for a flat cable of the first illustrative embodiment, when connecting the flat cable 1 and the connector 2 for a flat cable, it is possible to contact-connect the connection terminal part of the flat cable 1 and the terminal 6 and to suppress the flat cable 1 from being unintentionally separated from the housing 5 just by inserting the flat cable 1 into the insertion part 10 of the housing 5 (that is, one touch structure).

Also, at a semi-inserted state where the flat cable 1 does not reach the holding defined position of the accommodation space in the housing 5, since the upper surface (the backside of the surface on which the flat cable holding surfaces 12*a*, 12*a* are formed) of the extension part 12*b* of the lock member 7 protrudes from the upper step surface of the housing 5, the semi-inserted state can be easily detected.

Furthermore, when the locking holes 4, 4 of the flat cable 1 are not locked with the flat cable holding parts 12*a*, 12*a*, since the upper surface of the extension part 12*b* of the lock member 7 protrudes from the upper step surface 5*a* of the housing 5, the semi-inserted state can be easily detected.

Also, since the lock release parts F of PTL 1 are independently provided at left and right sides, the locked state of the flat cable E is not released unless the lock release parts F of the left and right sides are pressed at the same time. However, according to the first illustrative embodiment, since the lock member 7 of the connector 2 for a flat cable has the configuration where the flat cable holding parts 12*a*, 12*a* are integrally formed through the extension part 12*b* and the left and right locking structures are connected, it has only to lift up the extension part 12*b* only so as to release the locked state. As a result, it is possible to easily separate the flat cable 1 from the connector 2 for a flat cable.

Furthermore, since the lock member 7 is pressed towards the housing 5 by the pressing members 8, the connector can be used irrespective of the mounting state of the connector 2 for a flat cable. That is, even when the connector 2 for a flat cable is mounted at a state where the lock member 7 is lower than the housing 5, since the lock member 7 is pressed towards the housing 5 by the pressing members 8, the connector can be used.

Also, since the lock member 7 is formed with the separation preventing locking parts 11 having a substantial L shape and the housing 5 is formed with the locking protrusions 20*b*, when the extension part 12*b* of the lock member 7 becomes distant from the housing 5 by a predetermined distance or longer, the separation preventing locking parts 11 and the locking protrusions 20*b* are locked, so that the lock member 7 is suppressed from separating from the housing 5. Also, it is possible to prevent the pressing members 8 from being excessively displaced.

Second Illustrative Embodiment

Figure 5:
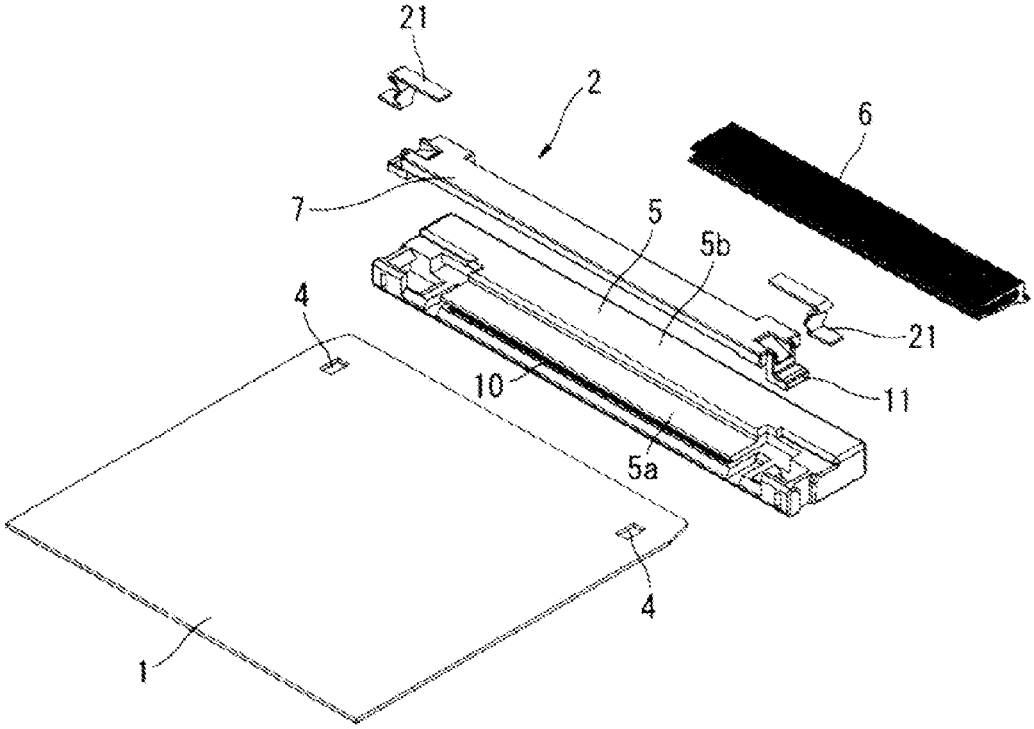
FIG. 5 is an exploded perspective view showing a connector for a flat cable according to a second illustrative embodiment and a flat cable.
Figure 6:
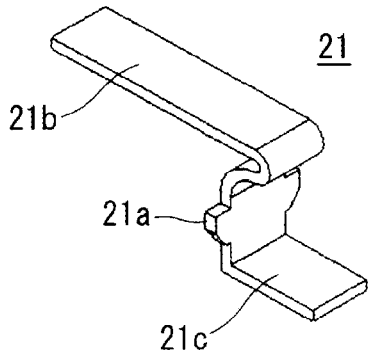
FIG. 6 is a perspective view showing a pressing member in the second illustrative embodiment.
Figure 7:
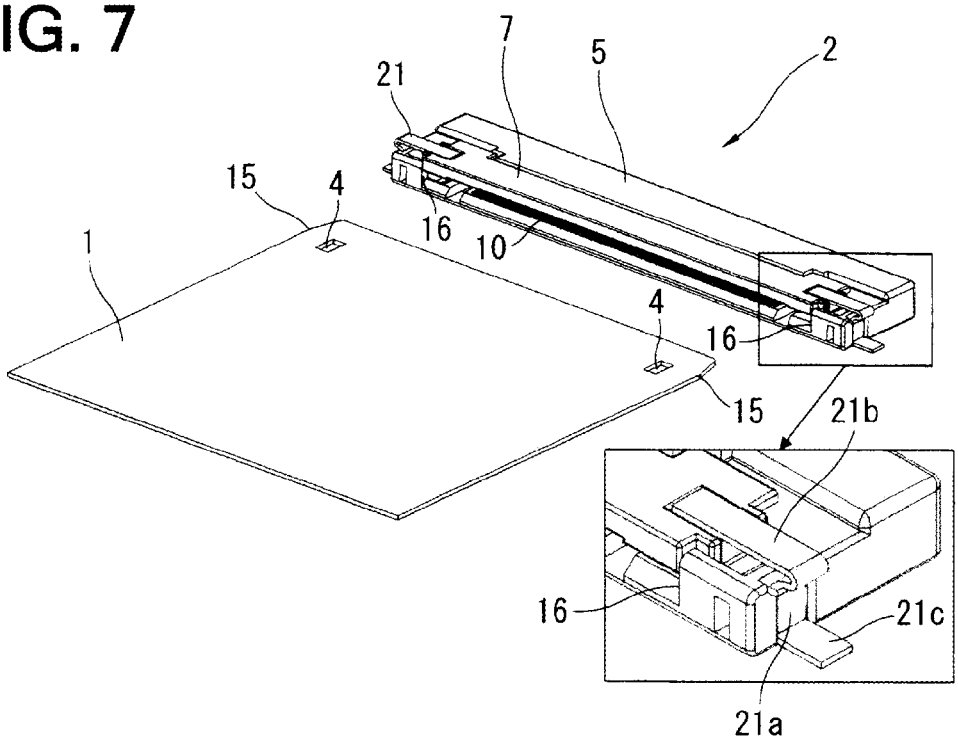
FIG. 7 is a perspective view showing the connector for a flat cable according to the second illustrative embodiment and the flat cable.
Figure 8:
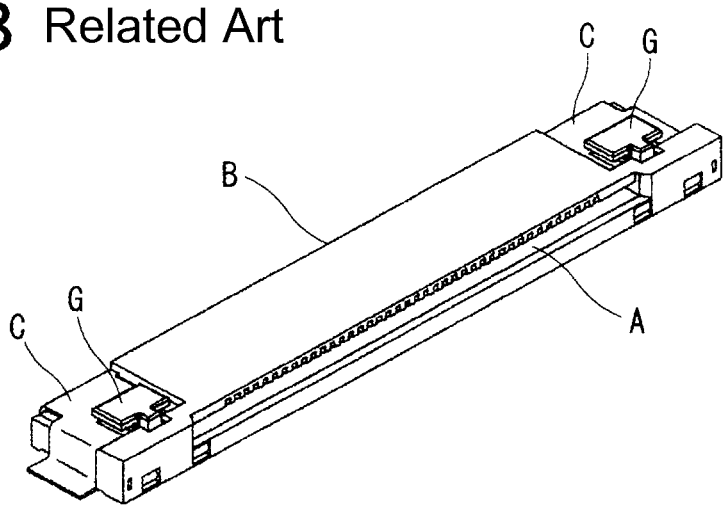
FIG. 8 Related Art
FIG. 8 is a perspective view showing an example of a connector for a flat cable according to the related art.
Figure 9:
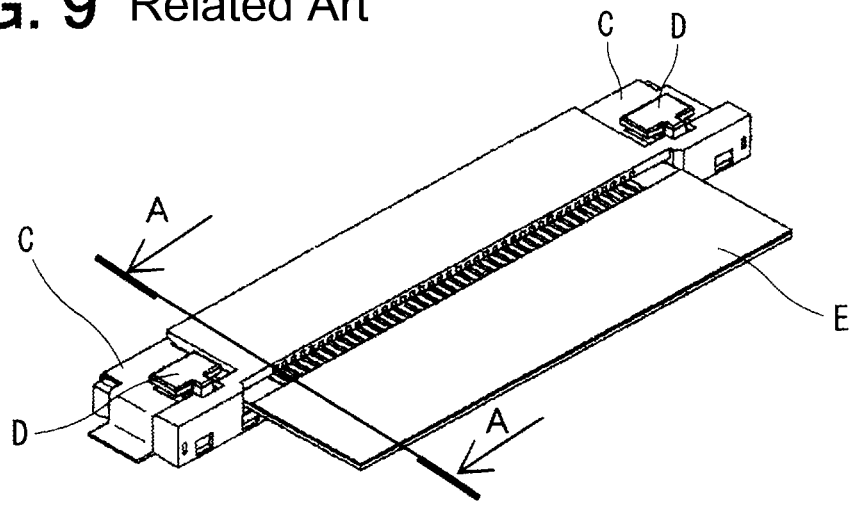
FIG. 9 Related Art
FIG. 9 is a perspective view showing an example of the connector for a flat cable and a flat cable in the related art.
Figure 10:
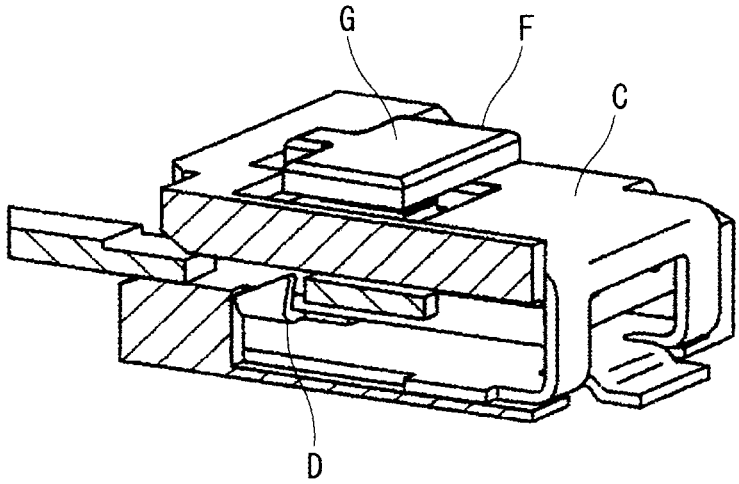
FIG. 10 Related Art
FIG. 10 is a sectional view taken along a line A-A, showing the connector for a flat cable at a state where the flat cable is locked.
Figure 11:
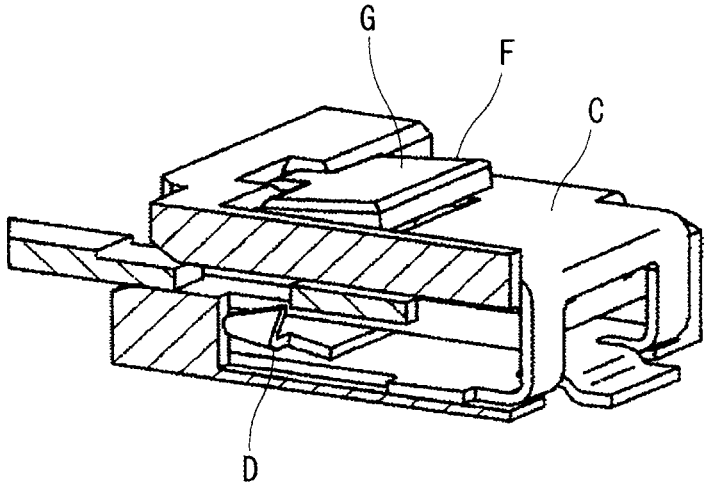
FIG. 11 Related Art
FIG. 11 is a sectional view taken along a line A-A, showing the connector for a flat cable at a state where the locked state of the flat cable is released.

In the below, a connector for a flat cable according to a second illustrative embodiment is described with reference to FIGS. 5 to 7.

In the second illustrative embodiment, a pressing member 21 is formed with a press-fitting part 21*a*, an arm part 21*b* and a soldering part 21*c* for fixation with an electronic component. Also, the fixing members 9 of the first illustrative embodiment are omitted. Since the other configurations are the same as those of the first illustrative embodiment, the descriptions thereof are omitted.

In the second illustrative embodiment, the connector 2 for a flat cable has two functions of fixing the electronic component and the housing 5 and pressing the lock member 7 with the one configuration of the pressing members 21, in addition to the operational effects of the first illustrative embodiment. Therefore, it is possible to reduce the number of components.

Although the invention has been specifically described with reference to the specific examples, it is apparent to one skilled in the art that a variety of changes and modifications can be made within the technical spirit of the invention and the changes and modifications are included in the claims.

For example, in FIG. 3, the separation preventing locking parts 11 are formed at both ends of the lock member 7. However, even when the separation preventing locking parts 11 are arranged on a side surface (a front side surface, a backside) of the lock member 7, the same effects are obtained.

INDUSTRIAL APPLICABILITY

This invention reduces the number of components for locking the flat cable and simplifies the jobs of connecting and separating the flat cable and the connector.

REFERENCE SIGNS LIST

1: flat cable
2: connector for a flat cable
4: locking hole
5: housing
5*a*: lower step surface
5*b*: upper step surface
6: terminal
7: lock member
8, 21: pressing member
8*a*, 21*a*: press-fitting part
8*b*, 21*b*: arm part
21*c*: fixing part
10: insertion part
12*a*: flat cable holding part
12*b*: extension part

What is claimed is:

1. A connector for a flat cable connecting a connection terminal part of a flat cable to an electronic device, the connector comprising:

a housing that is fixed to the electronic device and is formed with an insertion part into which a flat cable is inserted and a flat cable accommodation space that continues from the insertion part to an inside of the housing;

a terminal that is aligned and disposed in the housing, is connected to a wiring terminal provided to the electronic device and is contact-connected to the connection terminal part of the flat cable when the flat cable is inserted into the flat cable accommodation space through the insertion part;

a lock member that is put on a backside of a surface of the housing facing the electronic device and is formed with:

a pair of flat cable holding parts, which is engageable with locking holes formed at both side edge areas at a leading end-side of the flat cable when the connection terminal part of the flat cable is contact-connected to the terminal; and an extension part that extends over the pair of flat cable holding parts; and a pressing member that is formed with:

a press-fitting part that is press-fitted into a recess formed at the housing;

an arm part that is engaged with an engaging recess formed at the lock member and presses the lock member towards the housing; and a fixing part that is fixed to the electronic device, and wherein the backside of the surface of the housing facing the electronic device is formed into a step shape including a lower step surface forming a portion of a notch in which the lock member is accommodated and an upper step surface having no notch, and wherein the lock member is configured so that when the flat cable is inserted into the insertion part of the housing, the flat cable holding parts contact the leading end-side of the flat cable and are separated from the housing, and a backside of a surface of the extension part on which the flat cable holding parts are formed protrudes from the upper step surface of the housing, and so that when the flat cable reaches a holding position of the flat cable accommodation space and the connection terminal part of the flat cable are contact-connected to the terminal, the flat cable holding parts are engaged with the locking holes of the flat cable and come close to the housing, and the backside of the surface of the extension part on which the flat cable holding parts are formed becomes flush with the upper step surface of the housing.

* * * * *